United States Patent [19]

Ohkawara et al.

[11] Patent Number: 4,767,240

[45] Date of Patent: Aug. 30, 1988

[54] PILE-FRAMED STRUCTURE

[75] Inventors: Shigeaki Ohkawara; Yukio Oka, both of Tokyo, Japan

[73] Assignee: Tobishima Corporation, Tokyo, Japan

[21] Appl. No.: 923,542

[22] Filed: Oct. 27, 1986

[30] Foreign Application Priority Data

Jul. 16, 1986 [JP] Japan ..... 61-165659

[51] Int. Cl.[4] ..... E02D 5/20; E02D 5/34; E02B 3/06

[52] U.S. Cl. ..... 405/225; 405/222; 405/195; 405/21; 405/227

[58] Field of Search ..... 405/21, 25, 30, 33–35, 405/195, 216, 222–225, 227, 231, 233, 239, 244, 256, 257, 273, 285; 52/743, 744

[56] References Cited

U.S. PATENT DOCUMENTS

| | | | |
|---|---|---|---|
| 790,230 | 5/1905 | Stempel | 405/222 X |
| 1,952,380 | 3/1934 | Leeman | 405/285 X |
| 3,728,864 | 4/1973 | Wiswell | 405/216 |
| 3,890,794 | 6/1975 | Broadfoot | 405/222 X |
| 4,498,817 | 2/1985 | Oulsnam | 405/244 X |
| 4,588,327 | 5/1986 | Lin | 405/244 |

FOREIGN PATENT DOCUMENTS

| | | | |
|---|---|---|---|
| 329403 | 7/1903 | France | 405/256 |
| 96314 | 6/1984 | Japan | 405/21 |
| 233217 | 11/1985 | Japan | 405/21 |
| 246910 | 12/1985 | Japan | 405/21 |
| 130520 | 6/1986 | Japan | 405/256 |

*Primary Examiner*—David H. Corbin
*Assistant Examiner*—John A. Ricci
*Attorney, Agent, or Firm*—Sughrue, Mion, Zinn, Macpeak and Seas

[57] ABSTRACT

An underwater pile-framed structure comprises a plurality of upright piles 11 arranged in two parallel and spaced rows, reinforcing cages 13 surrounding the piles in peripherally spaced relationship thereto, and precast block stacks 22, 23 connecting together the piles in the two rows and surrounding individual pile-cage assemblies in each row. The piles are driven into the seabed in two spaced and parallel rows, the reinforcing cages are lowered over the piles to predetermined positions, the blocks are stacked over the cages to connect together the pile-cage assemblies in the two rows, and concrete is poured into the annular clearances between the piles and the block stacks.

2 Claims, 3 Drawing Sheets

PILE-FRAMED STRUCTURE

BACKGROUND OF THE INVENTION

This invention relates to underwater pile-framed structures such as breakwaters, sea berths, ocean culture facilities and other ocean pile-framed structures and more particularly, to offshore pile-framed structures which are adapted to bear the whole weight of block stacks by means of pile groups.

There have been proposed and practically employed a variety of underwater pile-framed structures for supporting block stacks. In one of the prior arts (1) a flange is secured to a selected point along the length of an upright pile (as shown in Japanese Patent Application Publication No. 6203/1986, for example), in another prior art (2) inner and outer annular wedge members tapering in the opposite directions are disposed about an upright pile to hold the pile in position (as shown in Japanese Laid-Open Patent Application Publication No. 39220/1981, for example) and in a further prior art (3) annular blocks are suspended from the tops of upright piles by means of wire ropes (as shown in Japanese Patent Application Publication No. 17484/1981, for example). In the above-mentioned prior arts, mortar is filled in the annular clearance defined betwen the pile and the hole in the block stack supported by the flanges, fixed support point means or annular members.

The arrangement comprising the piles having the flanges secured thereto (1) has the drawbacks that the flanges interfere with the driving of the piles into the bottom of the seabed and that the flanges on the piles tend to lie in different planes depending upon the degree of precision with which the piles are driven and the geology and unevenness of the seabed. The arrangement in which the inner and outer wedges form the fixed support point means (2) has the drawback that the breakwater structure to be constructed requires a relatively large number of parts and is complicated in construction resulting in difficulty of assembling.

Although the arrangement in which the annular members are suspended from the tops of the piles by means of wire ropes (3) eliminates the drawbacks inherent in the prior arts (1) and (2), in the arrangement (3), the weight of the block stacks is supported only by the tops of the piles through the annular members and wire ropes and the block stacks and piles are practically separate from each other from the view point of construction. That is, although the clearances defined between the pile receiving holes in the block stacks and the piles are filled with mortar and the mortar merely fills up the clearances, it can not be said that the block stacks and piles are integral with each other from the view point of structure. Thus, when either one of the block stacks on one hand and the piles on the other hand are applied external forces thereto, the filling mortar is simply insulated from the block stacks or piles and thus, external forces such as wave force and force of ships in mooring applied to the block stacks can not be smoothly transmitted to the piles or external force such as earthquake applied to the piles can not be smoothly transmitted to the block stacks. Thus, the breakwater structure constructed by the method of the prior art (3) has a quite low resisting force against external force.

SUMMARY OF THE INVENTION

Therefore, the present invention is to provide a pile-framed structure which effectively eliminates the drawbacks of the prior arts referred to hereinabove.

According to one aspect of the present invention, there is provided a pile-framed structure which comprises a plurality of piles having vertically spaced ribs on the outer surfaces and arranged in a plurality of spaced and parallel rows, reinforcing cages surrounding said piles in peripherally spaced relationship to the piles and having annular block bases at the lower ends and precast blocks stacked one upon another on said block support bases and having roughened holes surrounding the pile-cage assemblies to define annular clearances between the piles and the holes to be filled with concrete so as to embed said reinforcing cages, said ribs and said roughened holes therein.

The above and other objects and attendant advantages of the present invention will be more readily apparent to those skilled in the art from a reading of the following detailed description in conjunction with the accompanying drawings which show one preferred embodiment of the present invention for illustration purpose only, but not for limiting the scope of the same in any way.

BRIEF DESCRIPTION OF THE DRAWINGS

The accompanying drawings show one preferred embodiment of the present invention wherein the invention is applied to a pier in which.

PREFERRED EMBODIMENT OF THE INVENTION

Figure 3:
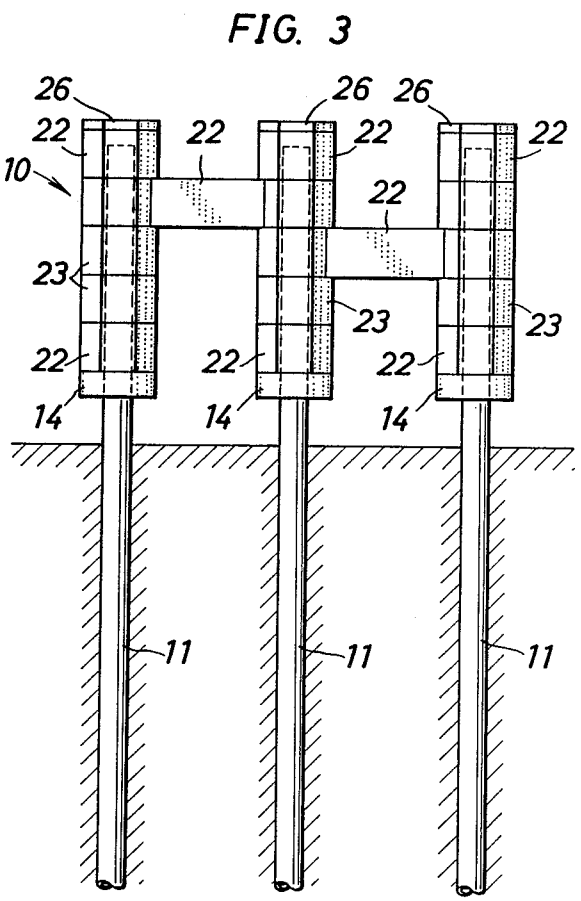
FIG. 3 is a schematic side elevational view of the pile-framed structure of FIG. 1.
Figure 2:
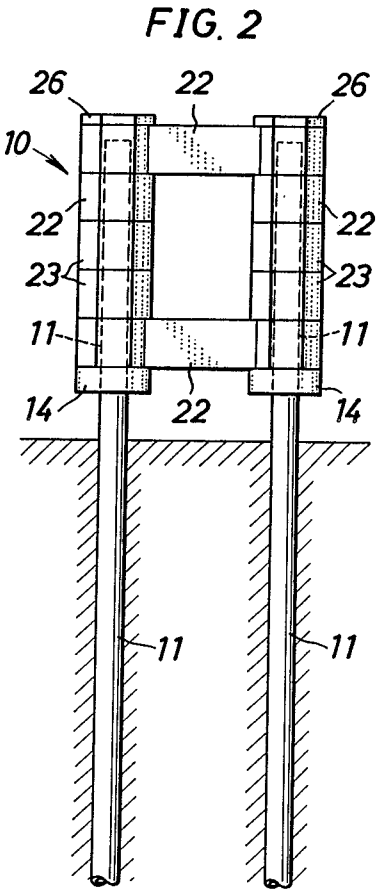
FIG. 2 is a schematic front elevational view of the pile-framed structure of FIG. 1.
Figure 1:
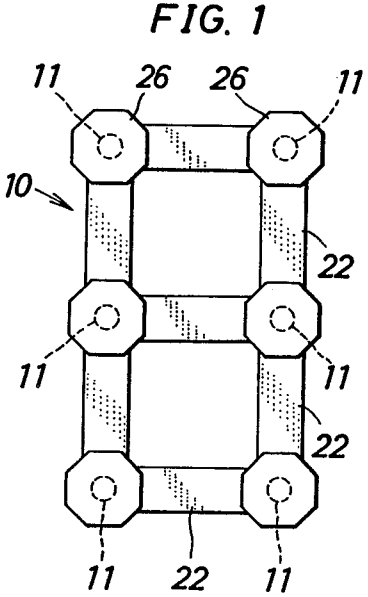
FIG. 1 is a schematic top plan view of the pile-framed structure embodying the principle of the present invention.
Figure 4:
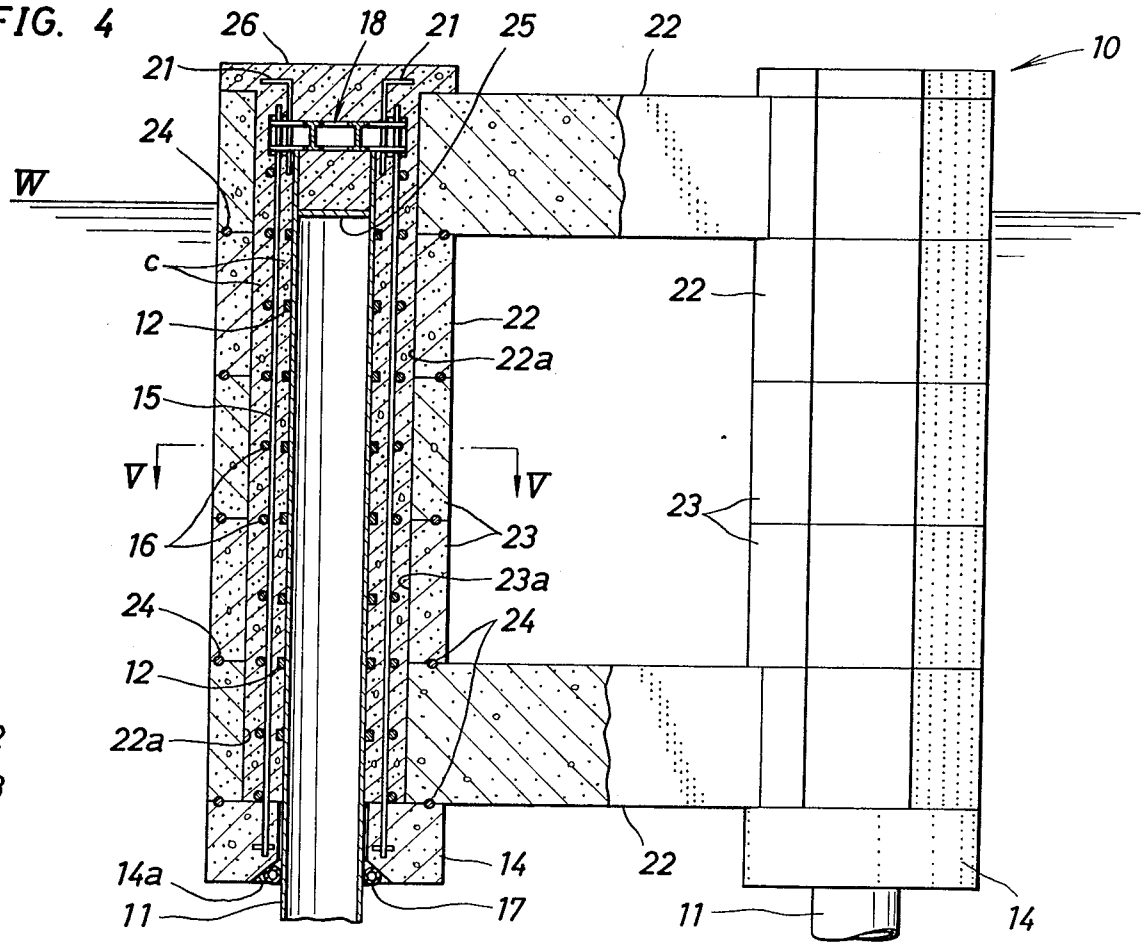
FIG. 4 is a fragmentary vertically sectional view on an enlarged scale of the pile-framed structure with a portion thereof cut away.
Figure 5:
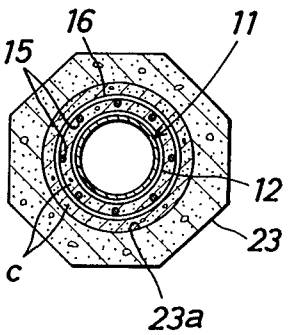
FIG. 5 is a cross-sectional view taken along the line V—V and as seen in the arrow direction in FIG. 4.
Figure 6:
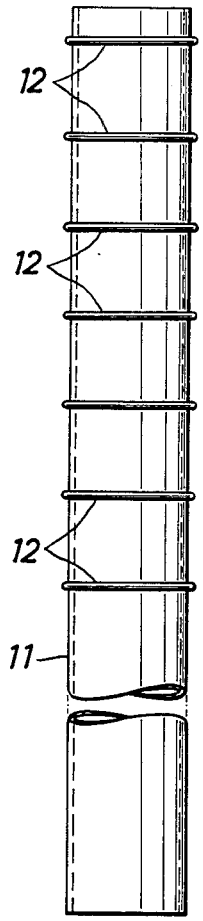
FIG. 6 is a side elevational view of one of the piles with a portion thereof cut away.
Figure 7:
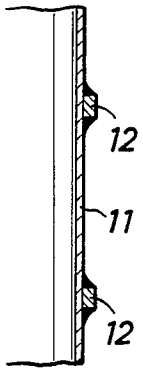
FIG. 7 is a fragmentary vertically sectional view of some ribs on the pile as shown in FIG. 6.
Figure 8:
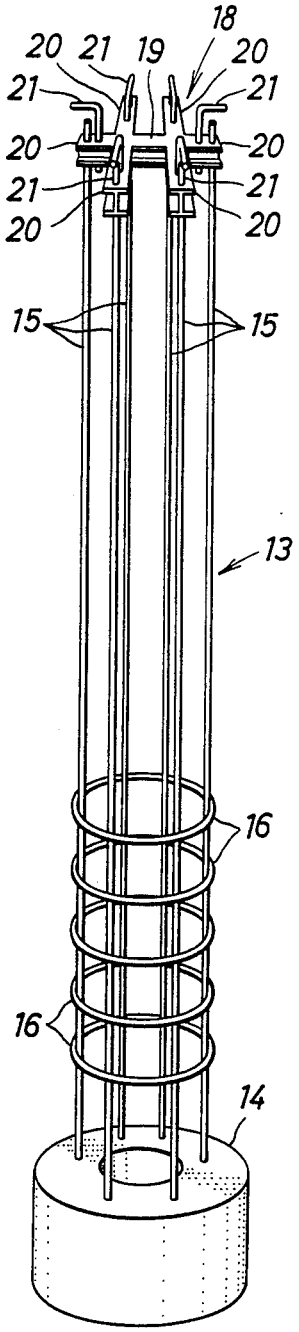
FIG. 8 is a perspective view of one of the reinforcing cages.

The present invention will be now described referring to the accompanying drawings in which the preferred embodiment of the invention is illustrated as being applied to a pier. The pile-framed structure embodying the invention is generally shown by reference numeral 10. The rectangular pile-framed structure 10 generally comprises a plurality of laterally spaced upright hollow piles 11, 11. . . driven into the seabed with portions thereof projecting above the surface of the water W and arranged in a first row and the same number of the piles 11 similarly driven and arranged in a second row parallel to and spaced from the first row, respectively. In the illustrated embodiment, three piles 11 (for example) are arranged in spaced relationship in each row in the longitudinal direction of the pile-framed structure and two piles 11 (for example) are arranged in spaced relationship in the transverse direction of the pile-framed structure 10, respectively. The pile 11 has a plurality of vertically spaced annular ribs 12 provided on the outer surface thereof for the purpose to be described hereinafter. The piles 11 may be formed of steel pipes or reinforced concrete pipes, but in the illustrated embodiment, the piles are formed of steel pipes. The annular ribs 12 are welded to the outer surface of the associated pile 11. The annular ribs 12 may be any other shape other than the illustrated annular shape provided that the ribs can assist concrete in securing itself to the pile when concrete is placed as will be described hereinafter and thus, the ribs may be sectors arranged in staggering relationship about the associated pile 11, for example. A reinforcing cage 13 surrounds the associated upright pile 11 in peripherally spaced relationship to the latter. The cage 13 comprises an annular base 14 formed of reinforced concrete and having the inner diameter greater than the outer diameter of the ribs 12, a plurality of circumferentially spaced upright reinforcing bars 15 (6 reinforcing bars in the illustrated embodiment) extending vertically upwardly from the bases 14 and a plurality of vertically spaced hoops 16 surrounding and secured to the reinforcing bars 15 in different heights in the length of the bars. The annular base 14 is positioned along the associated pile 11 in a position below the lowermost rib 12 and formed on the undersurface at the inner peripheral edge of the base with an annular notch **14*a* for receiving an annular water stop gasket 17. The base 14 is also formed on the upper surface with an annular recess for the purpose to be described hereinafter. The cage 13 further includes a connector-suspension member 18 in an upper end portion to connect the reinforcing bars 15 together and rest on the top of the pile 11 so as to suspend the cage 13 from the associated pile. The connector-suspension member 18 is formed of I-steel bar and includes a central portion 19 and six arms 20 radially outwardly extending from the central portion 19 and each having an inverted L-shaped reinforcing bar 21 extending upwardly and then radially outwardly from the associated arm 20. Each of the arms 20 has a through hole (not shown) through which the reinforcing bar 15 extends and is secured to the associated arm 20** by suitable means such as welding or a nut.

In assembling the cage 13 to the associated pile 11, the cage 13 is first fitted on the pile at the upper end thereof and then slid down along the pile until the connector-suspension member 18 rests on the top of the associated pile 11 and the base 14 is positioned below the lowermost rib 12 on the pile 11 to thereby form a pile-cage assembly.

In the illustrated embodiment, prior to assembling the cage 13 to the associated pile 11, three piles 11 are arranged in the first row and three piles 11 are arranged in the second row parallel to and spaced from the first row and then the levels of the tops of the piles are determined and based on the determination results, the positions of the connector-suspension members 18 to be rested on the piles are suitably adjusted so that when the cages 13 are fitted on the piles 11, the bases 14 of the cages 13 lie in the same level whereby the bases 14 of the cages 13 are aligned with each other in the same plane regardless of unevenness of the seabed into which the piles are driven and the degree of precision with which the piles are driven.

Reference numeral 22 denotes first or longer precast blocks which connect together adjacent pile-cage assemblies in the same row and opposing pile-cage assemblies in the first and second rows and have their opposite ends provided with circular holes **22*a* having a diameter greater than the outer diameter of the cage 13, but smaller than the outer diameter of the base 14 to define an annular clearance between the outer surface of the pile 11 and the inner surface of the hole 22*a*. Reference numeral 23 denotes second or shorter precast blocks which are disposed about individual pile-cage assemblies and have center circular holes 23*a* having a diameter greater than the outer diameter of the cage 13, but smaller than the outer diameter of the base 14 to define an annular clearance between the outer surface of the pile 11 and the inner surface of the hole 23*a*. The inner surfaces of the holes 22*a*, 23*a* in the first and second precast blocks 22, 23** are roughened for the purpose to be described hereinafter.

One of the first precast blocks 22 is directly positioned on the upper surfaces of the annular bases 14 of the two opposing pile-cage assemblies (one assembly is in the first row and the other assembly is in the second row). Second precast blocks 23 are stacked one upon another on the one first precast block 22 surrounding individual ones of the above-mentioned two opposing pile-cage assemblies in the first and second rows. First precast blocks 22 are placed on the topmost second precast blocks 23 in stacks in a direction at right angles to the direction of the lowermost first precast block 22 resting on the above-mentioned bases 14 to connect together adjacent pile-cage assemblies in the same row. Another first precast block 22 is placed on the second-mentioned first precast block 22 in a direction at right angles to the latter to connect between the above-mentioned two opposing pile-cage assemblies in the first and second rows with the arms 20 disposed within the hole **22*a* in the topmost first precast block 22 and upper portions of the inverted L-shaped reinforcing bars 21 projecting above the precast block. It will be understood that the second precast blocks 23 serve as spacers between the first precast blocks 22. The first and second precast blocks 22 and 23 are formed on the upper and lower surfaces thereof with annular recesses for receiving annular water stop packings 24 except for the topmost first precast block which is formed on only the lower surface with such an annular recess. The packings 24 provide water stop function under the weight of the stacks of the blocks 22 and 23. A transverse closure member 25 is fitted and held in the hollow pile 11** in a suitable upper portion thereof. The remaining pile-cage assemblies in the first and second rows are in succession are connected together by repeating the above-mentioned arrangement until the pile-framed structure to which the present invention is directed is completed.

Concrete is filled in the annular clearances defined between the outer surfaces of the hollow piles 11 and the inner surfaces of the holes **22*a*, 23*a* in the precast blocks 22, 23 and is firmly secured to the piles and the precast blocks by means of the ribs 12 on the piles 11 and the roughened surfaces of the holes 22*a*, 23*a* in the precast blocks 22, 23**.

Reference numeral 26 denotes T-shaped concrete top cover members formed when the annular clearances are filled with concrete and covering the projecting upper portions of the inverted L-shaped reinforcing bars 21.

The pile-framed structure constructed in accordance with the present invention is a so-called reinforced concrete (RC) structure in which concrete c filled in the clearances between the inner surfaces of the holes **22*a***, 23a in the precast blocks 22, 23 and the outer surfaces of the piles 11 embeds the cages 13 therein. And the concrete firmly secures itself to the piles 11 and precast blocks 22, 23 by means of the ribs 12 on the piles 11 and the roughened inner surfaces of the holes 22a, 23a in the precast blocks 22, 23.

That is, since the piles 11 and precast block stacks 22, 23 are rigidly connected together into a unitary assembly, the arrangement of the piles and precast blocks in the pile-framed structure of the invention has a remarkably enhanced resistance against external forces, those from such as waves and the like.

In the construction of the pile-framed structure described hereinabove, a plurality of the piles 11 are driven in a first row from the surface of the water W into the seabed and a plurality of the piles 11 are similarly driven in a second row spaced from and parallel to the first row into the seabed with each one of the piles in the second row aligning with the corresponding one in the first row. The piles 11 are so driven that upper portions of the piles project above the surface of the water W. The cages 13 are then lowered about and along the respectively associated piles 11. The downward movement of the cages 13 continue until the connector-suspension members 18 rest on the tops of the piles 11 and the bases 14 are positioned in a position below the lowermost ribs 12 on the piles 11 whereby the cages are suspended from the piles. Thereafter, the first and second precast blocks 22, 23 are stacked one upon another on the bases 14 surrounding the cages 13 by means of the holes 22a, 23a in the blocks 22, 23 so that the first precast blocks 22 connect between adjacent piles 11 in the same row and between the aligned piles 11 in the first and second rows. Finally, concrete c is poured into the annular spaces defined by the piles 11 and the holes 22a, 23a in the first and second precast blocks 22, 23 to fill up the clearances and at the same time form the top cover members 26 covering the open tops of the piles and the reinforcing bars 21.

The water stop gaskets 17 are disposed in the annular notches 14a in the bottom surfaces of the bases 14.

According to the present invention, prior to the pouring of concrete c, water filling the annular clearances defined between the piles 11 and the holes 22a, 23a in the first and second precast blocks 22, 23 is pumped out (the bottoms of the annular clearances are closed by the bases 14 and the water stop gaskets 17 in the bases) and filled with air.

When the pile-framed structure is constructed in the sea, the annular clearances filled with water are washed by pumping fresh water into the clearances, the fresh water is then pumped out of the clearances and the clearance is finally filled with air.

Also prior to the pouring of concrete c into the annular clearances, the open upper ends of the clearances and more particularly, upper portions of the holes 22a in the topmost precast blocks 22 are surrounded by suitable molds so as to cover upper portions of the inverted L-shaped reinforcing bars 21 and the closure members 25 are fitted and held in the piles 11 in a position slightly above the level of the bottom surfaces of the topmost precast blocks 22. Thereafter, concrete c is poured into the molds and annular clearances and allowed to solidify there and the solidified concrete fills up the annular clearances and at the same time forms the T-shaped top closure members 26 which close the top openings of the clearances to provide a RC structure and thus, in the pile-framed structure of the invention which the concrete firmly secures itself to the ribs 12 on the piles 11 and the roughened inner surfaces of the holes 22a, 23a in the precast blocks 22, 23 to thereby firmly connect the pile-cage assemblies and the precast block stacks together.

And if the pile-framed structure is a temporary structure, concrete may be also poured into the clearances with water filled in the clearances.

As described hereinabove, according to the present invention, since the cages are suspended from the tops of the piles with the bases of the cages disposed in a selected position about the piles below the lowermost ribs 12 thereon, the concrete filling the annular clearances defined between the inner surfaces of the holes in the precast blocks and the outer surfaces of the piles provides a so-called RC structure and the roughness of the inner surfaces of the holes in the precast blocks and the ribs on the piles allow the concrete to firmly secure itself to the piles and precast blocks, the piles and precast block stacks are firmly connected together by the RC structure into a rigid structure. Thus, external forces such as those from waves and ships in mooring applied to the precast block stacks are smoothly transmitted to the piles and external forces such as earthquake force and the like applied to the piles are also smoothly transmitted to the precast block stacks whereby the whole pile-framed structure can effectively resist against such external forces. Thus, the pile-framed structure of the invention has a substantially improved durability as compared with the prior art pile-framed structures in which the block stacks are merely supported from the tops of the piles.

In the present invention, if the piles having the ribs on the outer surfaces thereof, the cages having the annular bases at the lower ends and the connector-suspension members at the upper ends thereof and the precast blocks are preformed, the method for constructing the pile-framed structure according to the present invention can be simply performed.

What is claimed is:

1. A pile-framed structure, comprising:

(a) four vertically oriented, elongate piles (11) driven into a seabed with tops thereof extending above the surface of the water (w), said piles being arranged in a rectangular grid pattern including two spaced and parallel rows and two spaced and parallel columns, (b) a plurality of vertically spaced ribs (12) provided on and around the outer surface of each pile, (c) four reinforcing cages (13) individually installed over and surrounding the piles, each cage including an upper suspension member (18) resting on top of an associated pile and including a central portion (19) and a plurality of arms (20) extending radially outwardly from said central portion and each supporting an upwardly extending inverted L-shaped reinforcing bar (21), an annular lower support block base (14) closely fitted around the pile and disposed below a lowermost one of the ribs, and bar members (15) extending between the suspension member and the support block base and peripherally spaced from the pile, the bar members of each cage being circumferentially spaced around the suspension member and support block base with the upper ends of the bar members extending through the radially extending arms to enable varying the lengths of the cages before their installation over the piles to compensate for differing heights of the piles such that the support block bases of the cages are all disposed at the same level, and further comprising a plurality of hoops (16) vertically spaced around and secured to the bar members, (d) first and second pairs of elongate precast blocks (22) each having through holes (22*a*) at opposite ends thereof, said holes having roughened surfaces, the first pair of blocks being horizontally oriented and fitted over the suspension members and bar members of cages surrounding associated piles at opposite ends of said rows, and resting on the support block bases of said cages with said holes defining annular clearances surrounding the bar members and piles, and the second pair of blocks being horizontally oriented and similarly fitted over the cages and piles at opposite ends of said columns and resting on the first pair of blocks, and (e) concrete (c) poured into and filling the annular clearances defined by the first and second pairs of blocks, and embedding the reinforcing cages, the ribs and roughed surfaces therein to establish a rigid unitary structure.

2. A structure according to claim 1, further comprising a plurality of precast, centrally apertured, generally circular spacer blocks (23) individually disposed surrounding the piles and interposed between the first and second pairs of elongate blocks.

* * * * *